United States Patent [19]

Rashid et al.

[11] Patent Number: 4,990,310

[45] Date of Patent: Feb. 5, 1991

[54] CREEP-RESISTANT DIE CAST ZINC ALLOYS

[75] Inventors: Moinuddin S. Rashid, Bloomfield Hills; M. David Hanna, Royal Oak, both of Mich.

[73] Assignee: General Motors Corporation, Detroit, Mich.

[21] Appl. No.: 405,809

[22] Filed: Sep. 11, 1989

[51] Int. Cl.[5] ..... C22C 18/04; C22C 18/02; C22C 18/00

[52] U.S. Cl. ..... 420/514; 420/515; 420/516; 420/519; 148/441

[58] Field of Search ..... 420/515, 516; 148/441

[56] References Cited

U.S. PATENT DOCUMENTS

| | | | |
|---|---|---|---|
| 1,850,419 | 3/1932 | Schroeder et al. | 420/515 |
| 3,567,436 | 3/1971 | Isobe et al. | 420/516 |

*Primary Examiner*—R. Dean
*Assistant Examiner*—Robert R. Koehler
*Attorney, Agent, or Firm*—Douglas D. Fekete

[57] ABSTRACT

A creep-resistant die casting is formed of a zinc-base alloy comprising about 4 to 12 percent copper and about 2 to 4 percent aluminum. The die casting is characterized by an intimate dispersion of fine epsilon and eta phases effective to retard slip and thereby enhance creep resistance.

3 Claims, 2 Drawing Sheets

CREEP-RESISTANT DIE CAST ZINC ALLOYS

BACKGROUND OF THE INVENTION

This invention relates to die cast zinc-base alloys and, more particularly, to a die cast zinc-aluminum-copper alloy exhibiting superior creep resistance.

In a typical die casting operation, molten metal is injected at high pressure into a fixed-volume cavity defined by reusable water-cooled metal dies. Within the cavity, the metal is molded into a desired configuration and solidified to form a product casting. The metal is injected into the cavity by a shot apparatus comprising a sleeve for receiving a charge of the molten metal and a plunger that advances within the sleeve to force the metal into the cavity. Two types of shot apparatus are known. A hot chamber apparatus comprises a shot sleeve immersed in a bath of the molten metal. In a cold chamber apparatus, the molten charge is transferred, for example by ladle, into the shot apparatus from a remote holding furnace.

Zinc-base alloys are commonly formed by die casting, in large part because of a conveniently low melting point. Heretofore, zinc die castings have exhibited a microstructure characterized by soft phases, such as the eta phase in zinc-aluminum alloys, that lack stability even at moderately high temperatures. As a result, such alloys have had poor high temperature creep resistance that has restricted their use, mainly to decorative parts.

It is known to form sand castings of a zinc alloy comprising between about 3 and 6 weight percent aluminum and between about 5 and 11 weight percent copper. Magnesium in an amount up to about 0.05 weight percent is also typically present. The alloy is characterized by a microstructure that includes a hard epsilon phase that increases bulk hardness and wear resistance in comparison to other common sand-cast zinc alloys. Thus, the alloy is well suited for material-forming dies such as sheet metal forming dies or plastic molding dies.

It has now been found that zinc-aluminum-copper alloys that form the epsilon phase not only are suitable for die casting by either cold chamber processes or hot chamber processes, but also exhibit a surprising increased creep resistance at elevated temperatures, which, in combination with their high hardness and wear resistance, allow the die cast alloy to be used in applications not suitable for conventional epsilon-free zinc-base die castings.

It is an object of this invention to provide a die casting composed of a zinc-base aluminum-copper alloy having a microstructure comprising a dispersed epsilon phase, which die casting exhibits not only high hardness and wear resistance, but also a remarkably increased high-temperature creep resistance, particularly in comparison to conventional zinc die castings.

SUMMARY OF THE INVENTION

In accordance with a preferred embodiment, a die casting of this invention is composed of an alloy consisting essentially of, by weight, between 4 and 11 percent copper, between 2 and 4 percent aluminum, up to 0.05 percent magnesium and the balance zinc and impurities.

A uniform melt of the alloy is prepared and cast by either a hot chamber die casting process or a cold chamber die casting process. In either case, the melt solidifies within the fixed-volume die cavity under conditions that include rapid cooling by the surrounding water-cooled dies and applied pressure by the shot apparatus.

During the initial stages of cooling and solidification, fine epsilon grains form and are dispersed throughout the melt. Upon further cooling, an eta phase formation is nucleated at the epsilon grains, whereupon the composite grains become dispersed in a ternary eutectic matrix. The resulting microstructure comprises an intimate combination of fine epsilon and eta phases that is particularly resistant to slip. As a result, the product die casting exhibits improved strength and wear resistance principally due to the epsilon phase, but also a dramatically improved creep resistance, particularly in comparison to similar zinc die castings that are substantially epsilon free, that is attributed to the intimate combination of the fine phases.

DESCRIPTION OF THE DRAWINGS

The present invention will be further illustrated with reference to the drawings wherein.

DETAILED DESCRIPTION OF THE INVENTION

Figure 1:
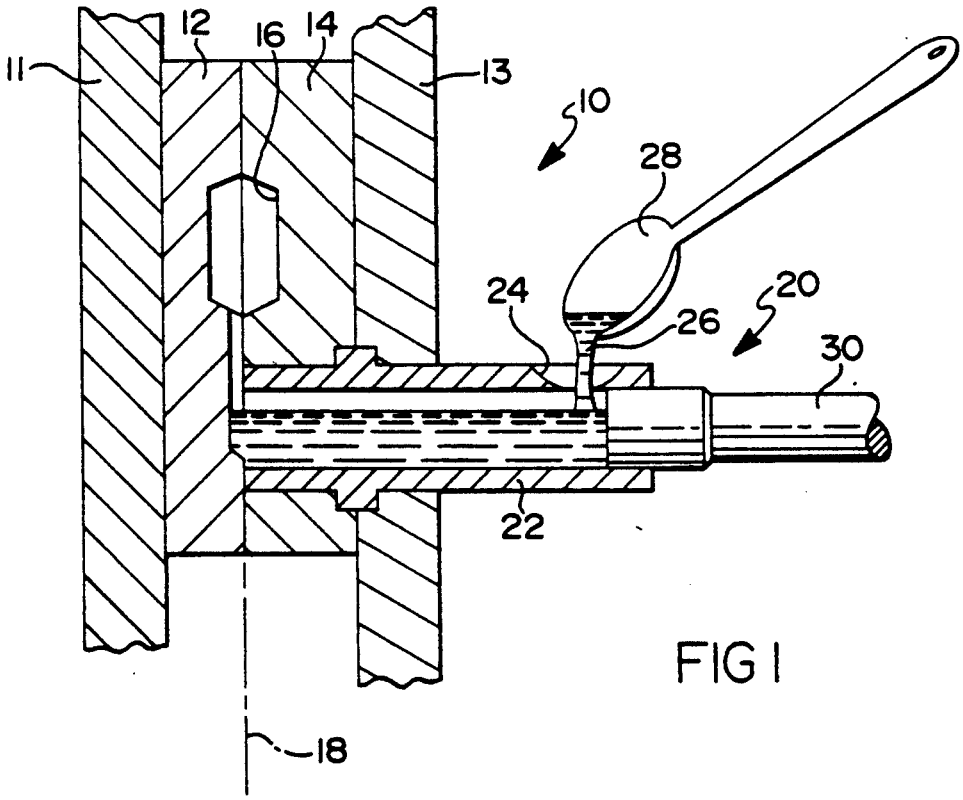
FIG. 1 is a cross sectional view of a cold chamber die casting apparatus for casting zinc-aluminum-copper alloy in accordance with this invention.

In a first example of this invention, a die casting was formed of a zinc-base aluminum-copper alloy using a conventional cold chamber die casting machine shown schematically in FIG. 1. Machine 10 comprises a movable platen 11 and a stationary platen 13. Die halves 12 and 14 are mounted on platens 11 and 13, respectively, and cooled by water circulated through passages (not shown) therein. In the closed position shown in the figure, die halves 12 and 14 cooperate to define a fixed-volume die cavity 16 suitably sized and shaped for producing a casting of a desired configuration. At appropriate times during the casting cycle, platen 11 moves relative to platen 13 to part die halves 12 and 14 along a plane indicated by line 18 for ejection of a product casting. Machine 10 also includes a shot apparatus 20 comprising a generally cylindrical shot sleeve 22 that communicates with cavity 16. Sleeve 22 includes an inlet 24 for admitting a molten metal charge 26 poured, for example, from a suitable ladle 28. A hydraulically driven shot plunger 30 is slideably received in sleeve 22 and advances toward the die sections for forcing metal from sleeve 22 into cavity 16.

In accordance with a preferred embodiment of this invention, charge 26 was composed of an alloy comprising 10.0 weight percent copper, 3.6 weight percent aluminum, 0.03 weight percent magnesium and the balance zinc and impurities. The charge was poured at a temperature of about 532° C. into shot sleeve 22 through port 24. Slot plunger 30 was advanced to inject the charge into casting cavity 16. The cavity surface temperature was about 140° C. After filling the die cavity, the shot plunger continued to apply a load of 1340 kilograms for about 12 seconds. Within the die cavity, the metal cooled and solidified, whereafter the die sections were parted to eject a product casting.

Figure 2:
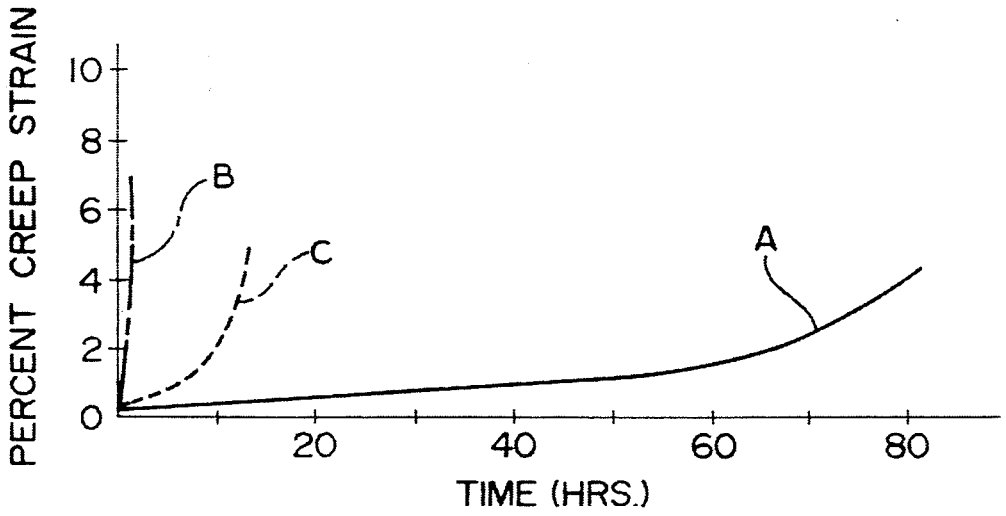
FIG. 2 is a graph showing creep strain as a function of time for zinc-base die castings including zinc-aluminum-copper die castings of this invention.

The product casting exhibited a Birnell hardness of 146. The creep properties of the product die casting was measured using a standard ASTM test designated E 139-83. Using a standard tensile creep test machine, a machined specimen was subjected to a tensile stress of 40 MPa while heated at 150° C. The results are shown by curve A in FIG. 2. As can be seen, the specimen exhibited less than 2 percent creep after 70 hours. For purposes of comparison, a specimen of a conventional, copper-free zinc die casting alloy formed by a similar cold chamber die casting process and composed of about 3.8 weight percent aluminum, 0.031 weight percent magnesium and the balance zinc and impurities, which alloy is designated Zamak 3, was subjected to a creep test under identical conditions, the results of which are indicated in curve B of FIG. 2. Also for purposes of comparison, a specimen of a second conventional zinc die casting alloy formed by a similar cold chamber process and composed of 2.3 weight percent copper, 31.1 weight percent aluminum, 0.03 weight percent magnesium and the balance zinc and impurities, which alloy is commonly designated ZA27, was creep tested under identical conditions and behaved as indicated by curve C in FIG. 2. As can be seen, the die casting of the present invention exhibits substantially improved creep resistance in comparison to the conventional zinc die castings.

Figure 3:
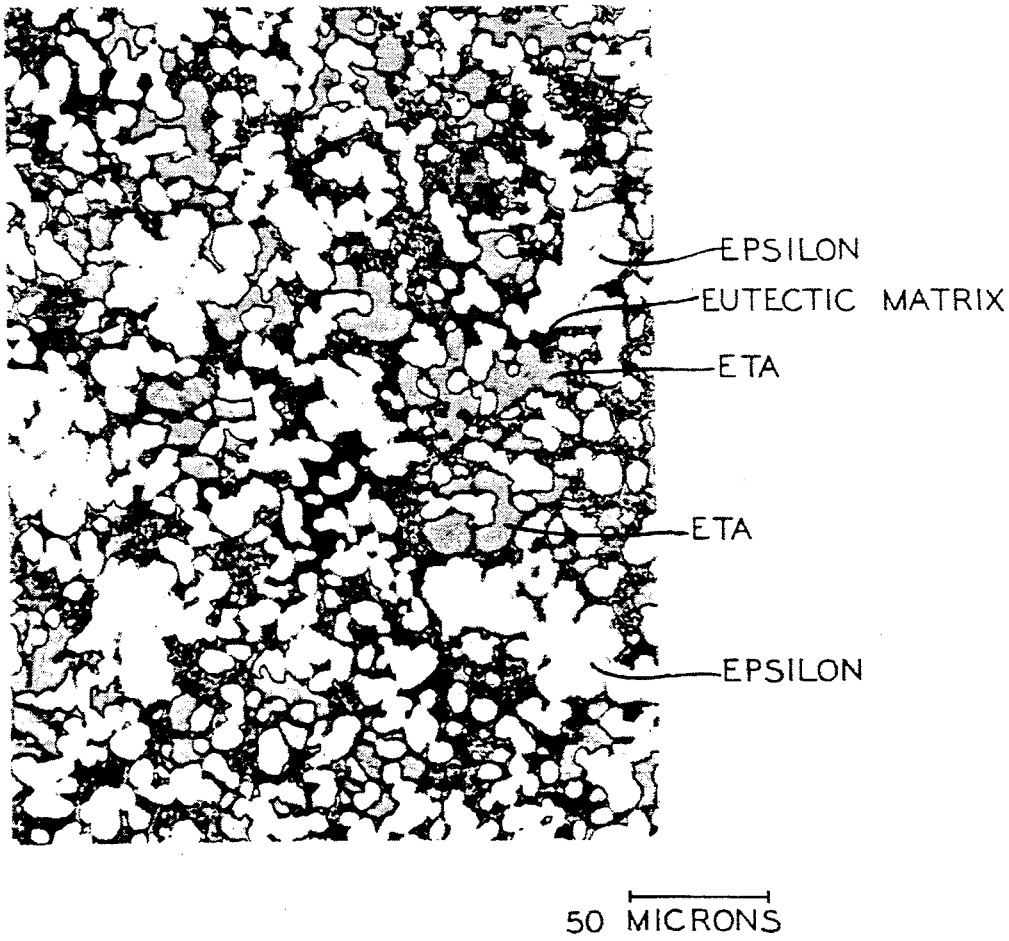
FIG. 3 is a photomicrograph of a zinc-aluminum-copper die casting of this invention.

The zinc-aluminum-copper die casting of this embodiment was sectioned and etched using a Natal solution. FIG. 3 shows a photomicrograph of the microstructure taking by a scanning electron microscope. The microstructure comprises fine grains composed of epsilon phase and eta phase dispersed in a ternary eutectic matrix. The epsilon phase has a hexagonal close packed lattice wherein lattice parameter a equals about 2.773 Angstroms and lattice parameter c equals about 4.312 Angstroms. The eta phase is also hexagonal close packed, but wherein lattice parameter a equals about 2.669 Angstroms and lattice parameter c equals about 4.907 Angstroms. It is believed that the intimate dispersion of the fine, hexagonal close packed phases with slightly different lattice parameters retards slip propagation between the phases and thereby enhances the resistance of the die casting to creep.

Figure 4:
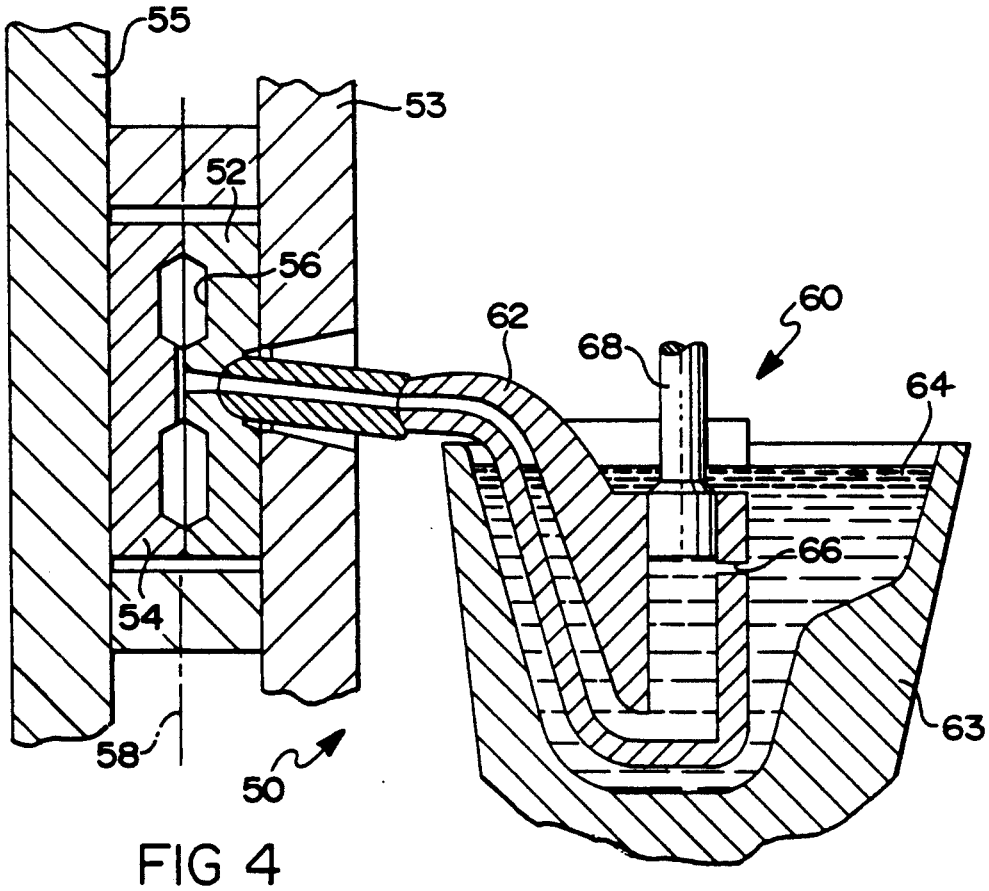
FIG. 4 is a cross sectional view of a hot chamber die casting apparatus for casting zinc-aluminum-copper die castings in accordance with this invention.

In a second embodiment, zinc die castings of this invention were manufactured using a hot chamber die casting machine 50 shown schematically in FIG. 4. Machine 50 comprises water-cooled die halves 52 and 54 mounted on a stationary platen 53 and a movable platen 55, respectively, adapted for moving die halves between a closed position shown in FIG. 4 wherein the die halves cooperate to form a casting cavity 56 and an open position wherein the die halves are parted along a plane indicated by line 58 for ejection of a product casting. In accordance with common hot chamber die casting process, die casting machine 50 comprises a shot apparatus 60 formed of a goose neck sleeve 62 partially submerged in a molten metal bath 64 contained in melting pot 63. Shot apparatus 60 further comprises hydraulically driven plunger 68 slideably received in goose neck 62. When plunger 68 is in a retracted position shown in the figure, a charge of molten metal from bath 64 fills goose neck 62 through an inlet port 66. For casting, plunger 68 is driven downwardly to force molten metal through sleeve 62 into die cavity 56.

In accordance with this invention, a hot chamber die casting was formed of an alloy containing 7.6 weight percent copper, 3.3 weight percent aluminum, 0.028 weight percent magnesium and the balance substantially zinc. The temperature of the charge was about 490° C. The casting cavity surface temperature was about 150° C. During injection, the melt was subjected to a pressing load of 62 kiloPascals.

The resulting casting exhibited a Brinell hardness of about 110. In comparison, a comparable die casting formed of Zamak 3 alloy containing 0.1 weight percent copper, 3.6 weight percent aluminum, 0.02 weight percent magnesium and the balance zinc exhibited a Brinell hardness of about 66. The die cast alloy of this invention is considered to have excellent creep resistance.

Suitable zinc alloys for the practice of this invention contain copper in amounts between about 4 and 12 weight percent, aluminum in an amount between about 2 and 4 weight percent, magnesium in an amount between 0.025 and 0.05 weight percent and the balance substantially zinc, plus iron and other typical impurities. For hot chamber die casting, the preferred copper content is between about 5 and 7 weight percent. Alloys containing less than 4 percent copper fail to form significant epsilon phase, whereas greater than about 8 percent copper results in an elevated melting point impractical for typical hot chamber die casting apparatus. In contrast, a preferred copper range for cold chamber alloy is between about 9 and 11 weight percent. Above about 12 weight percent copper, the formation of additional phases interfere with the desired epsilon-eta-eutectic microstructure.

A preferred aluminum range for alloys in the practice of the present invention is between about 2 and 4 weight percent. At least about 2 percent aluminum is desired to provide sufficient fluidity for convenient handling at common die casting temperature. Alloys having greater than about 4 percent aluminum develop unwanted alpha phase.

A minor presence of magnesium is desired to improve dimensional accuracy and reduce stress corrosion cracking. A preferred magnesium range is between about 0.025 and 0.05 weight percent.

The product casting of this invention is formed under conditions that include rapid solidification by a surrounding cooled die and intensification pressure applied by the injection apparatus. Under these conditions, cooling of the melt initially forms fine, dispersed epsilon grains, followed closely by fine eta grains and thereafter the eutectic matrix. For hot chamber die casting, the alloy is preferably cast at a temperature between about 410° C. and 490° C. and injected at a pressure between about 1500 MPa and 4500 MPa. Cold chamber die casting is preferably carried out at a temperature between about 480° C. and 650° C. and an injection pressure between about 4500 MPa and 10,000 MPa.

While this invention has been described in terms of certain embodiments thereof, it will be appreciated that other forms could be readily adapted by those skilled in the art. Accordingly, the scope of the invention is to be considered limited only by the following claims.

The embodiments of the invention in which an exclusive property or privilege is claimed are defined as follows:

1. A creep resistant zinc-base die casting consisting essentially of, by weight, between about 4 and 12 percent copper, 2 and 4 percent aluminum, up to 0.05 percent magnesium and the balance zinc and impurities, said die casting having fine epsilon and eta grains dispersed in a ternary eutectic matrix and exhibiting a creep strain at 150° C. subjected to a 40 MPa load of less than 2 percent after more than 70 hours.

2. The die casting of claim 1 wherein the die casting is formed by a hot chamber die casting process and contains between 4 and 7 weight percent copper.

3. The die casting of claim 1 wherein the die casting is formed by a cold chamber die casting process and contains between 7 and 11 percent copper.

* * * * *